US006932249B1

(12) United States Patent
Pugne

(10) Patent No.: US 6,932,249 B1
(45) Date of Patent: Aug. 23, 2005

(54) TOGGLE-ACTION DISPENSING CLOSURE, PACKAGE AND METHOD OF MAKING

(75) Inventor: Darin M. Pugne, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 141 days.

(21) Appl. No.: 10/375,738

(22) Filed: Feb. 26, 2003

(51) Int. Cl.[7] ..... B65D 47/00
(52) U.S. Cl. ..... 222/556; 222/536; 222/153.14
(58) Field of Search ..... 222/556–557, 222/554, 560, 533–536, 153.01, 153.14, 222/815, 252, 811

(56) References Cited

U.S. PATENT DOCUMENTS

| | | | | |
|---|---|---|---|---|
| 2,573,378 | A | 10/1951 | Zurlinden | |
| 3,081,005 | A | 3/1963 | O'Connor | |
| 3,168,221 | A | 2/1965 | Parker | |
| 3,180,541 | A | 4/1965 | Tupper | |
| 3,362,591 | A | 1/1968 | Latham | |
| 3,515,314 | A | 6/1970 | Waterman | |
| 4,645,086 | A * | 2/1987 | Rosenthal | 215/235 |
| 4,735,334 | A | 4/1988 | Abbott | |
| 4,775,065 | A | 10/1988 | Shastal | |
| 4,962,869 | A * | 10/1990 | Gross et al. | 222/153.14 |
| 5,190,176 | A | 3/1993 | Lavange | |
| 5,192,005 | A * | 3/1993 | Zimmerman | 222/148 |
| 5,279,451 | A * | 1/1994 | Mueller et al. | 222/507 |
| 5,341,960 | A * | 8/1994 | Lay | 222/153.05 |
| 5,379,926 | A | 1/1995 | Mueller | |
| 5,579,961 | A | 12/1996 | Zimmerman | |
| 5,762,228 | A * | 6/1998 | Morgan et al. | 220/367.1 |
| 5,788,108 | A | 8/1998 | Rohr | |
| 6,029,866 | A | 2/2000 | Wood | |
| 6,092,690 | A | 7/2000 | Bitowft | |
| 6,283,333 | B1 | 9/2001 | Knickerbocker et al. | |
| 6,343,725 | B1 * | 2/2002 | Lohrman | 222/536 |
| 6,367,670 | B1 | 4/2002 | Warner | |
| 6,409,054 | B1 | 6/2002 | Garibaldi | |
| 6,431,416 | B1 * | 8/2002 | Lohrman | 222/536 |

FOREIGN PATENT DOCUMENTS

| | | |
|---|---|---|
| DE | 8531116 | 12/1985 |
| EP | 0597246 | 5/1994 |
| WO | WO 9624533 | 8/1996 |

* cited by examiner

*Primary Examiner*—Frederick C. Nicolas

(57) ABSTRACT

A toggle-action dispensing closure according to one embodiment of the present invention includes a base having a deck with a dispensing opening, a recess adjacent to the deck and a toggle lid pivotally carried on the deck. The lid has a first portion overlying the deck and closing the dispensing opening in a closed position of the lid, and a second portion overlying the recess in the closed position of the lid. The lid can be pivoted between its closed and an open position in which the first portion of the lid is spaced from the deck and the second portion of the lid is disposed at least in part in the recess. The lid has a first protrusion and the base has second and third protrusions that cooperate with the first protrusion on the lid to releasably hold the lid in its closed position and in its open position respectively.

23 Claims, 8 Drawing Sheets

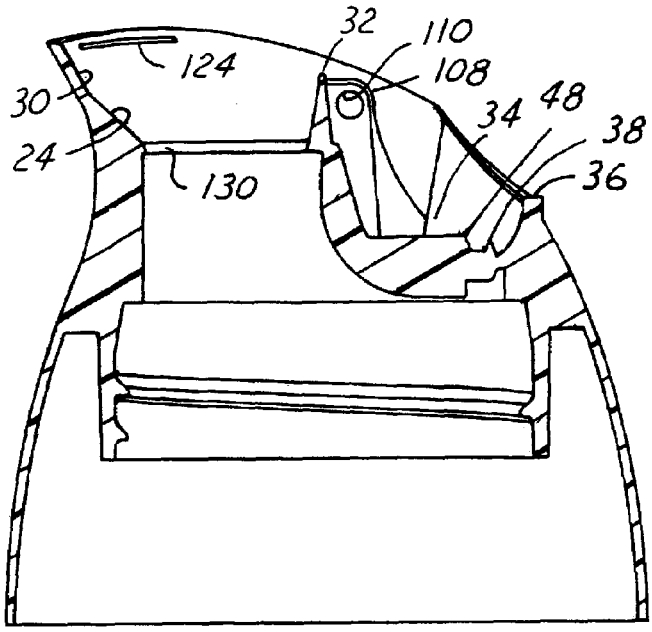
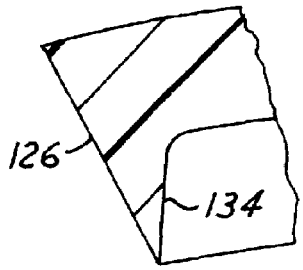
FIG.22
FIG.18
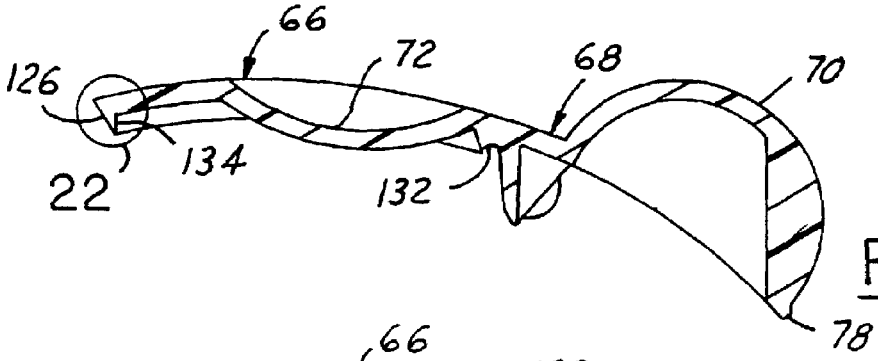
FIG.21
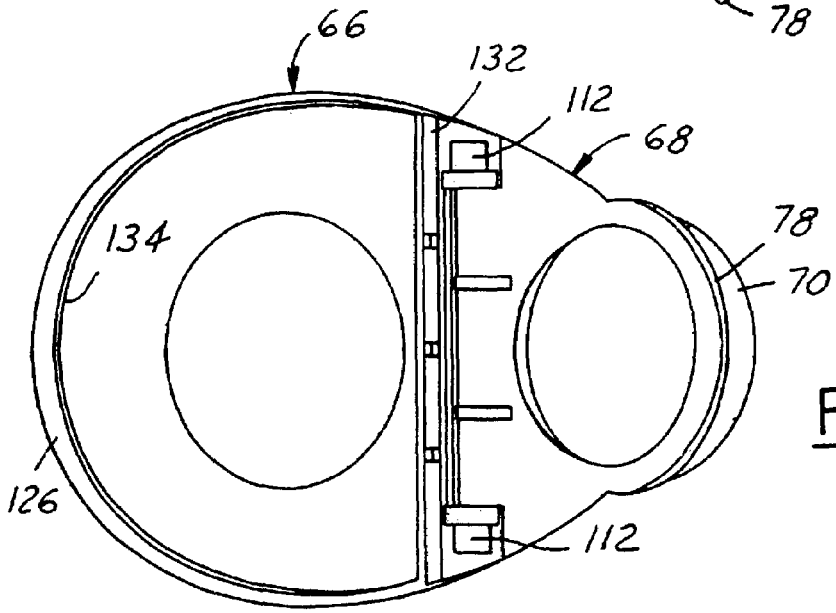
FIG.20

TOGGLE-ACTION DISPENSING CLOSURE, PACKAGE AND METHOD OF MAKING

FIELD OF THE INVENTION

The present invention is directed to packages for dispensing fluent products, and more particularly to a toggle-action dispensing closure, a package having such a closure and a method of making the same.

BACKGROUND OF THE INVENTION

Toggle-action dispensing closures typically include a base constructed to be secured to the finish of a container, and a lid pivotally mounted on the base. Closures of this type may have a cam that engages both a lower lip of the lid to hold the lid in its closed position and an upper surface of the lid to releasably hold the lid in its open position. An actuating portion of the lid can pivot into a recess in the base which is generally open to a deck portion of the base.

SUMMARY OF THE INVENTION

A toggle-action dispensing closure according to one embodiment of the present invention includes a base having a deck with a dispensing opening, a skirt for securement to a container finish, a recess adjacent to the deck and a toggle lid pivotally carried on the deck. The lid has a first portion overlying the deck and closing the dispensing opening in a closed position of the lid, and a second portion overlying the recess in the closed position of the lid. The lid can be pivoted between its closed and an open position in which the first portion of the lid is spaced from the deck and the second portion of the lid is disposed at least in part in the recess. The base has first and second protrusions that cooperate with a third protrusion on the lid to releasably hold the lid in its closed position and in its open position respectively.

In another embodiment of the present invention, a dispensing closure comprises a base having a deck with a dispensing opening, a skirt for securment to a container finish, a recess adjacent to the deck and a toggle lid pivotal on the deck between open and closed positions. The toggle lid has a first portion that overlies the deck and closes the dispensing opening when the lid is in its closed position, and a second portion that overlies the recess when the lid is in its closed position. When the lid is pivoted to its open position, the first portion of the lid is spaced from the deck and the second portion of the lid is disposed at least in part in the recess. The closure base includes a wall upstanding from the deck to prevent the flow of product from the deck into the recess. Other aspects of the invention include a method of making such a toggle-action dispensing closure, and a package that includes a toggle-action dispensing closure secured to a container finish.

BRIEF DESCRIPTION OF THE DRAWINGS

The disclosed embodiments of the invention, together with additional objects, features and advantages thereof, will be best understood from the following description, appended claims and accompanying drawings in which:

FIG. 18 is a sectional view of the base;

FIG. 20 is a bottom view of the toggle lid;

FIG. 21 is a sectional view of the toggle lid; and

FIG. 22 is a fragmentary sectional view of the area in circle number 22 in FIG. 21.

DETAILED DESCRIPTION OF THE PREFERRED EMBODIMENTS

Figure 1:
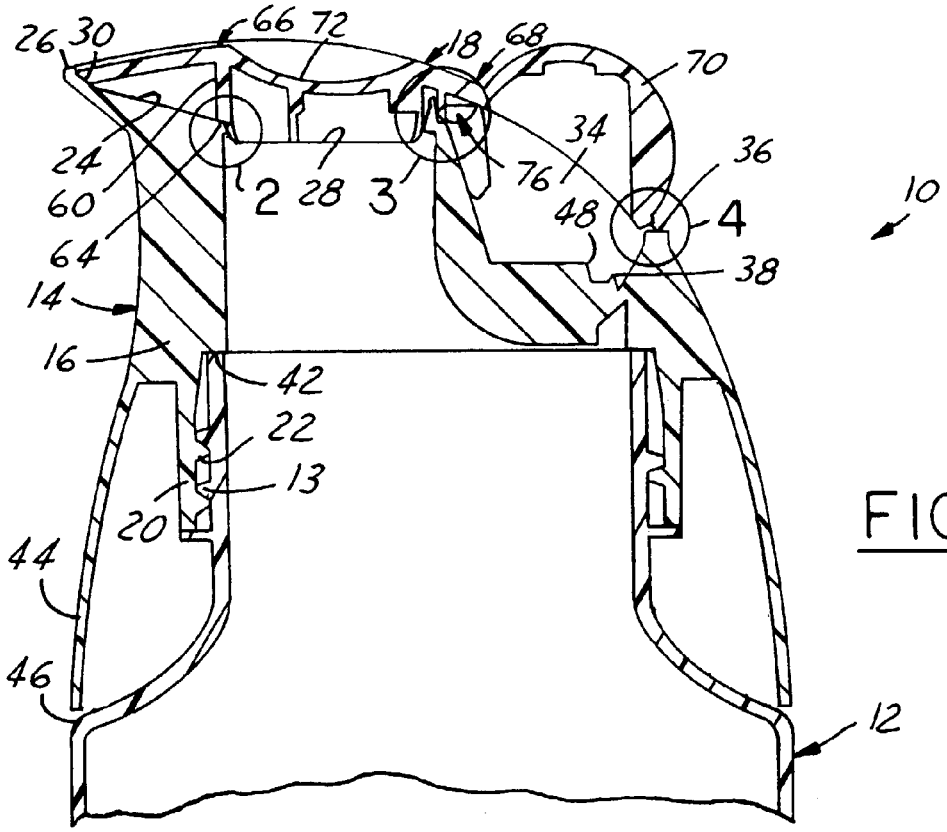
FIG. 1 is a fragmentary sectional view showing a closure secured to a finish of a container according to one exemplary embodiment of the present invention.
Figure 2:
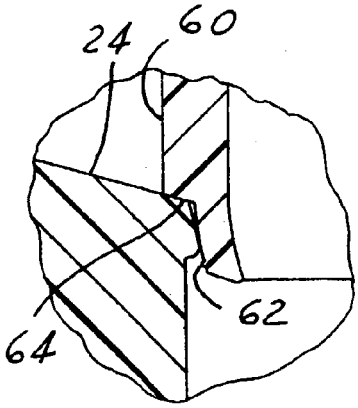
FIG. 2 is a fragmentary sectional view of the area in circle number 2 in FIG. 1.
Figure 3:
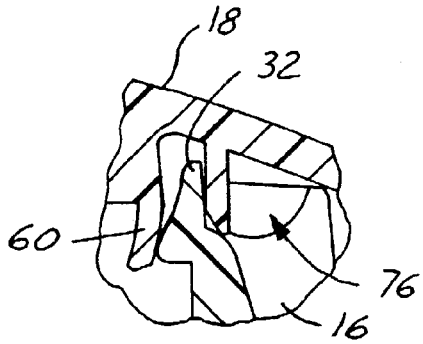
FIG. 3 is a fragmentary sectional view of the area in circle number 3 in FIG. 1.

Referring in more detail to the drawings, FIGS. 1–11 illustrate a closure and container package 10 in accordance with one presently preferred embodiment of the invention. The container 12 may be of any suitable construction, such as flexible, resilient molded plastic, and preferably has a generally cylindrical finish with one or more external threads or beads 13 to facilitate securing the closure 14 on the container. The closure 14 includes a base 16 and a toggle lid 18.

The base 16 has a skirt 20 with one or more internal threads or beads 22 that cooperates with the external threads or beads 13 on the container finish for securing the closure 14 to the container finish. The base 16 has a deck 24 disposed beneath an upper edge 26 of the base 24, and has a dispensing opening 28 for dispensing product from within the package 10. An angled lip 30 defines the upper edge of the base, and extends radially and axially from a periphery of the deck 24 to drain any excess product dispensed from the opening 28 back onto the deck 24 and toward the dispensing opening 28. An upstanding wall 32 extends across the deck 24 between opposed sides of the lip 30 and behind the dispensing opening 28 to prevent or at least substantially inhibit liquid product from draining into a recess area 34 of the base 16 defined behind the wall 32.

Figure 5:
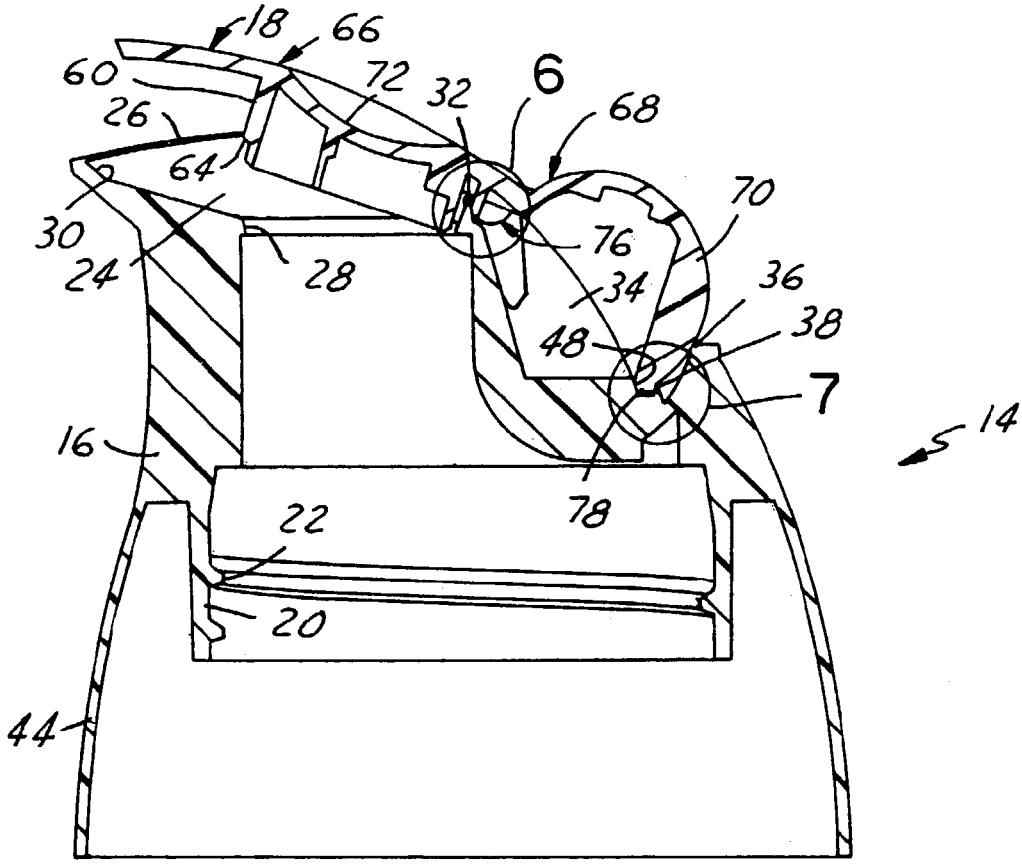
FIG. 5 is a sectional view of the closure of FIG. 1 with a lid of the closure shown in its open position.
Figure 6:
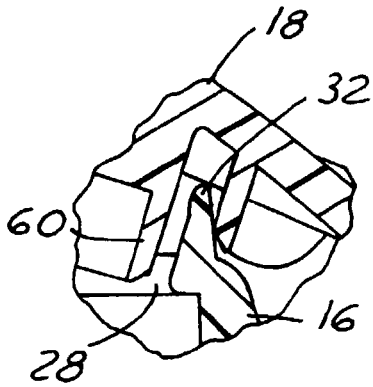
FIG. 6 is a fragmentary sectional view of the area in circle number 6 in FIG. 5.

The recess area 34 of the base receives a portion of the toggle lid 18 when the toggle lid is pivoted to its open position, as shown generally in FIG. 5. A pair of spaced protrusions 36, 38 are formed in the recess area 34 of the base 16. In the embodiment shown, a first protrusion 36 is adjacent to an upper edge 40 of the recess area 34, and a second protrusion 38 is disposed further within the recess area 34. A radially inwardly extending shoulder 42 adjacent to the skirt 20 of the base 16 preferably seals against an upper end of the container finish when the closure is secured on the container. An exterior depending skirt 44 on the base 16 surrounds the inner skirt 20 and blends generally with an enlarged diameter shoulder 46 of the container. A wall 48 extending upwardly from the bottom of the recess 34 provides a stop that limits movement of the toggle lid 18. In the embodiment shown, a pair of spaced pockets 50 (FIG. 8) are formed on opposite sides of the lip 30, immediately behind the wall 32. These pockets 50 define in part a pivot about which the toggle lid 18 pivots between its open and closed positions as will be discussed more fully below.

The toggle lid 18 is best shown in FIGS. 1–7, 10 and 11. The toggle lid 18 has a depending plug seal wall 60 adapted to be closely received within the dispensing opening 28 in the closed position of the toggle lid to close and seal the opening 28, as shown generally in FIG. 1. A snap bead 62 (FIG. 2) may be formed at the lower end of the plug seal wall 60 to aid in releasably holding the lid 18 in its closed position. A stop 64 may be provided adjacent to the plug seal wall 60 to limit the extent to which the plug seal wall 60 may be inserted into the dispensing opening 28. The plug seal wall 60 is carried by a first portion 66 of the toggle lid 18 which overlies the deck 24 and is preferably received against the lip 30 when the toggle lid 18 is in its closed position. A second portion 68 of the toggle lid 18 extends oppositely of the first portion 66 and overlies the recess 34 when the toggle lid 18 is in its closed position. The second portion 68 may comprise at least in part an upstanding semi-spherical button 70 for ease of engagement and actuation of the toggle lid 18. Likewise, a concave depression 72 may be formed in the first portion 66 of the toggle lid 18 to provide an ergonomic actuation area to facilitate moving the toggle lid 18 to its closed position.

Figure 10:
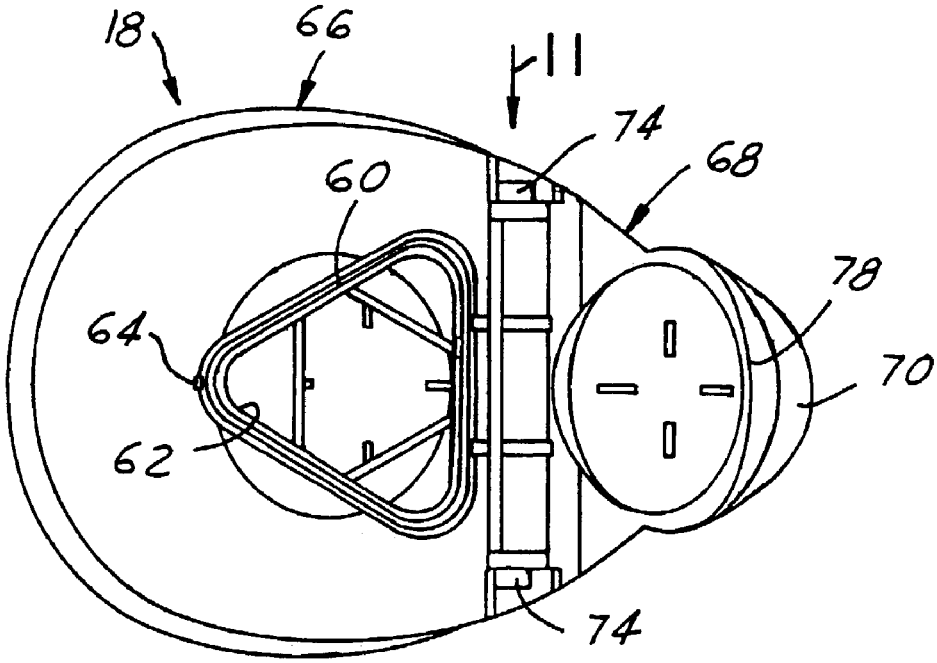
FIG. 10 is a bottom view of the toggle lid.
Figure 11:
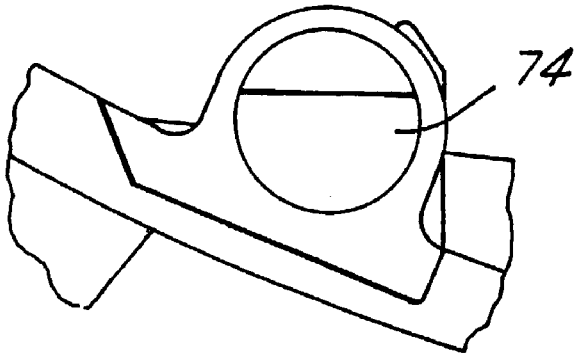
FIG. 11 is a fragmentary side view of the closure taken generally in the direction of the arrow 11 in FIG. 10.
Figure 12:
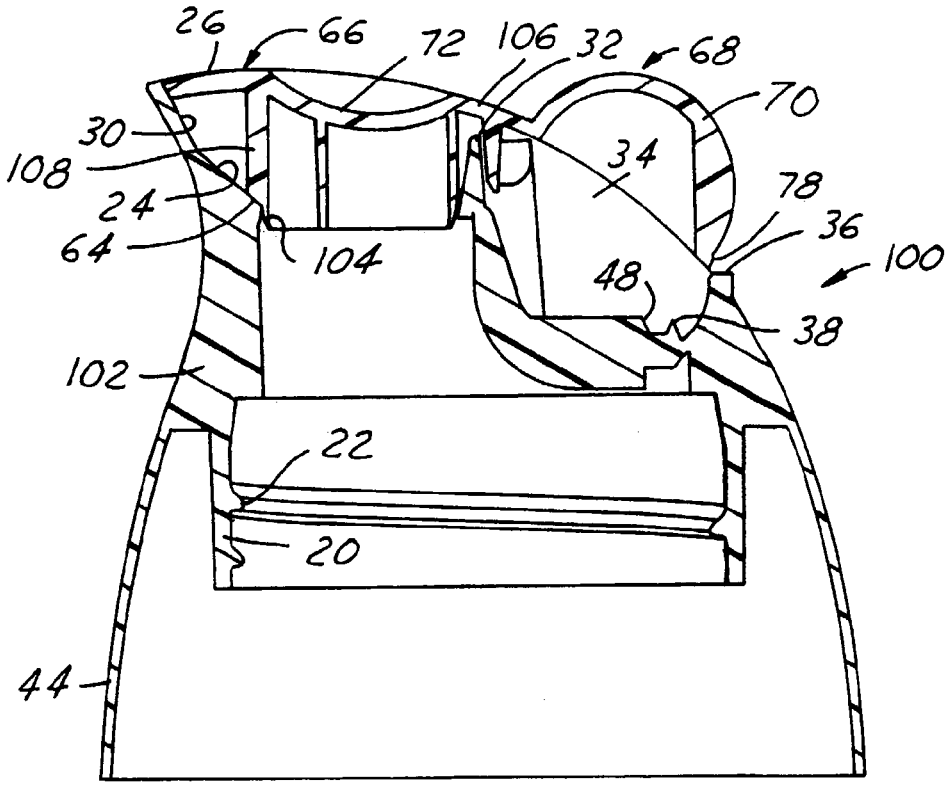
FIG. 12 is a sectional view of a closure according to a second exemplary embodiment of the present invention.

As best shown in FIGS. 10 and 11, a pair of spaced apart trunions 74 are carried by the lid 18 and are received within the pockets 50 in the base 16 in assembly of the closure 14. The trunions 74 are rotatably received in the pockets 50 so that the trunions and pockets define a pivot 76 about which the lid 18 rotates or pivots between its open and closed positions. The pivot 76 is preferably provided generally between the first portion 66 and second portion 68 of the lid 18 such that when the second portion 68 is depressed the lid 18 rotates about the pivot 76 from its closed position towards its open position. And when the first portion 66 of the lid 18 is depressed, the lid rotates about the pivot 76 from its open position to its closed position.

Figure 4:
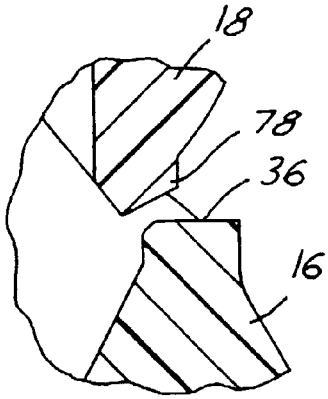
FIG. 4 is a fragmentary sectional view of the area in circle number 4 in FIG. 1.
Figure 7:
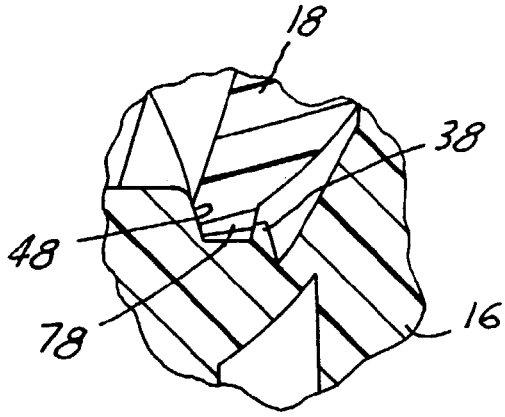
FIG. 7 is a fragmentary sectional view of the area in circle number 7 in FIG. 5.
Figure 8:
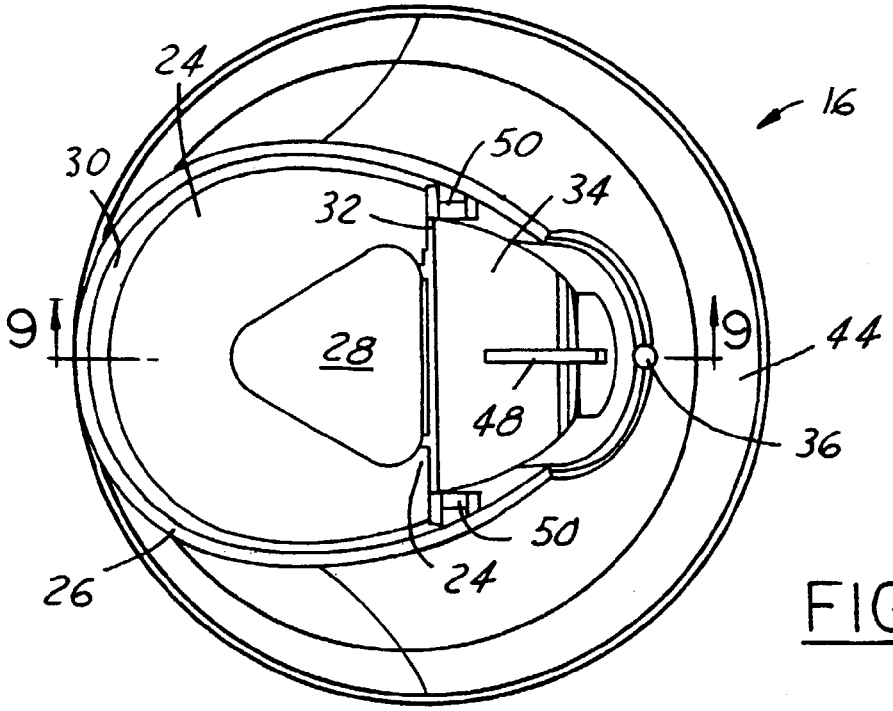
FIG. 8 is a plan view of a base of the closure.
Figure 9:
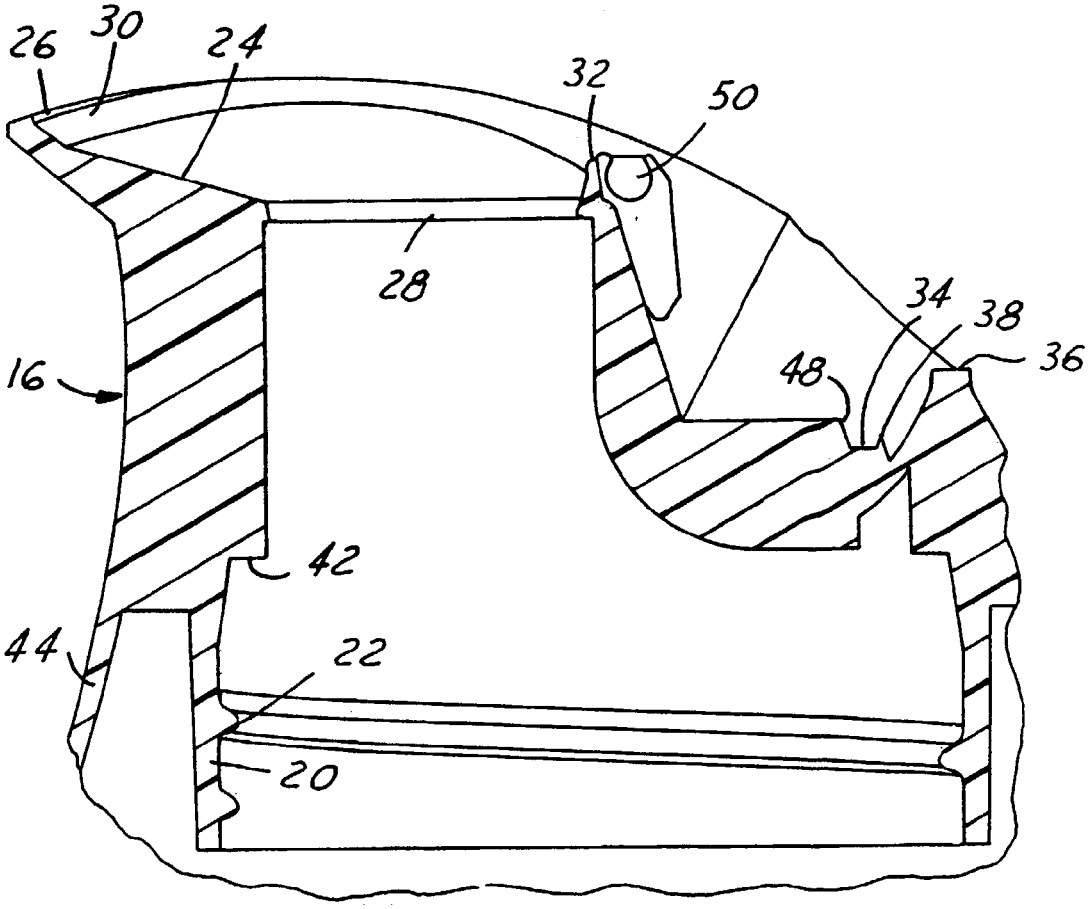
FIG. 9 is a fragmentary sectional view of the base.

A third protrusion 78 is preferably formed on the second portion 68 of the toggle lid 18. The third protrusion 78 cooperates with and overlies a portion of the first protrusion 36 to releasably hold the toggle lid 18 in its closed position, as shown in FIGS. 1 and 4, and cooperates with, such as by snap-retention, the second protrusion 38 to releasably hold the toggle lid 18 in its open position, as shown in FIGS. 5 and 7. Preferably, the third protrusion 78 on the toggle lid 18 is formed at the rearward and lower most edge of the button 70 that defines in part the second portion 68 of the toggle lid 18.

FIGS. 12–15 illustrate a closure 100 according to a second presently preferred embodiment of the present invention. The second embodiment closure 100 has many of the same features as the first embodiment closure 14. To the extent they are the same, the same reference numbers used with reference to the first embodiment enclosure will be applied to the second embodiment closure 100.

Figure 13:
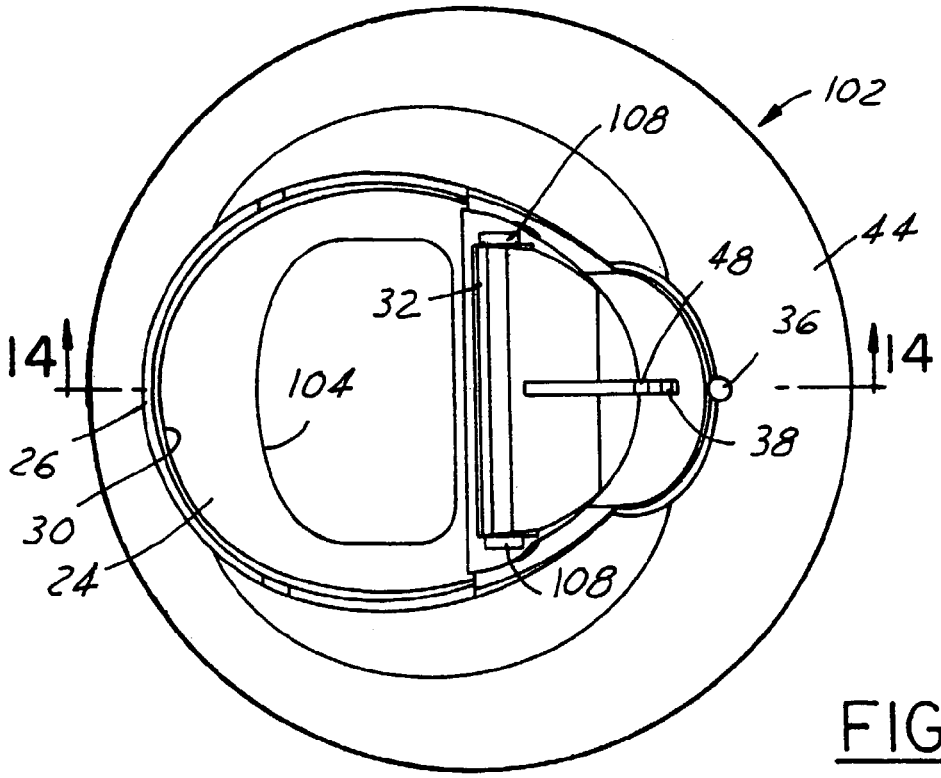
FIG. 13 is a plan view of a base of the closure shown in FIG. 12.
Figure 14:
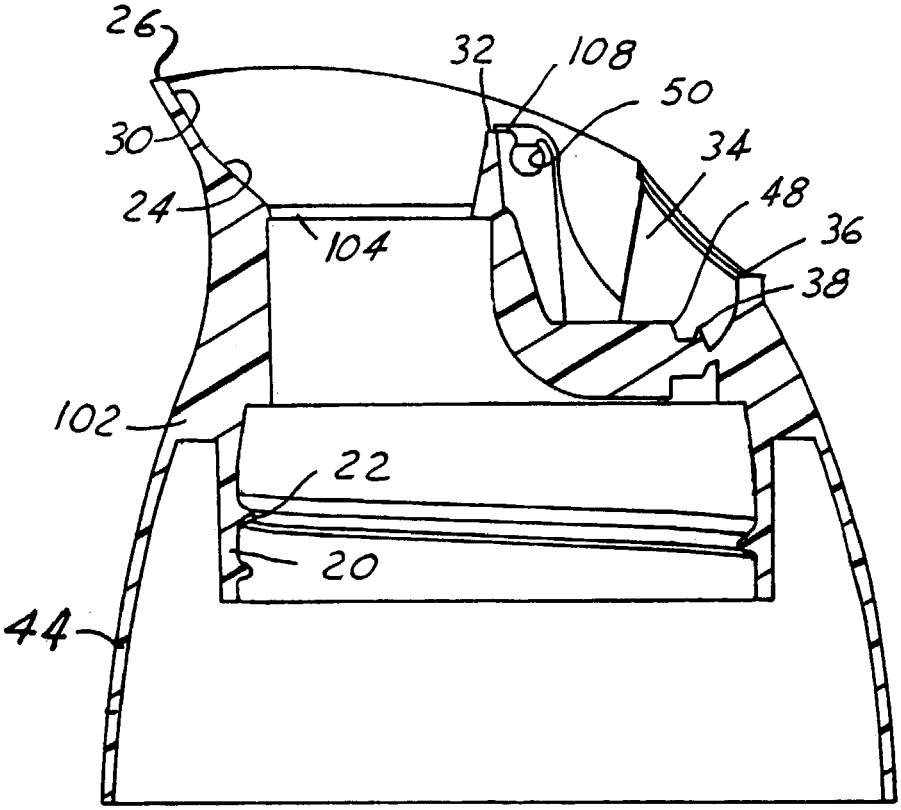
FIG. 14 is a sectional view taken generally along line 14—14 in FIG. 13.
Figure 15:
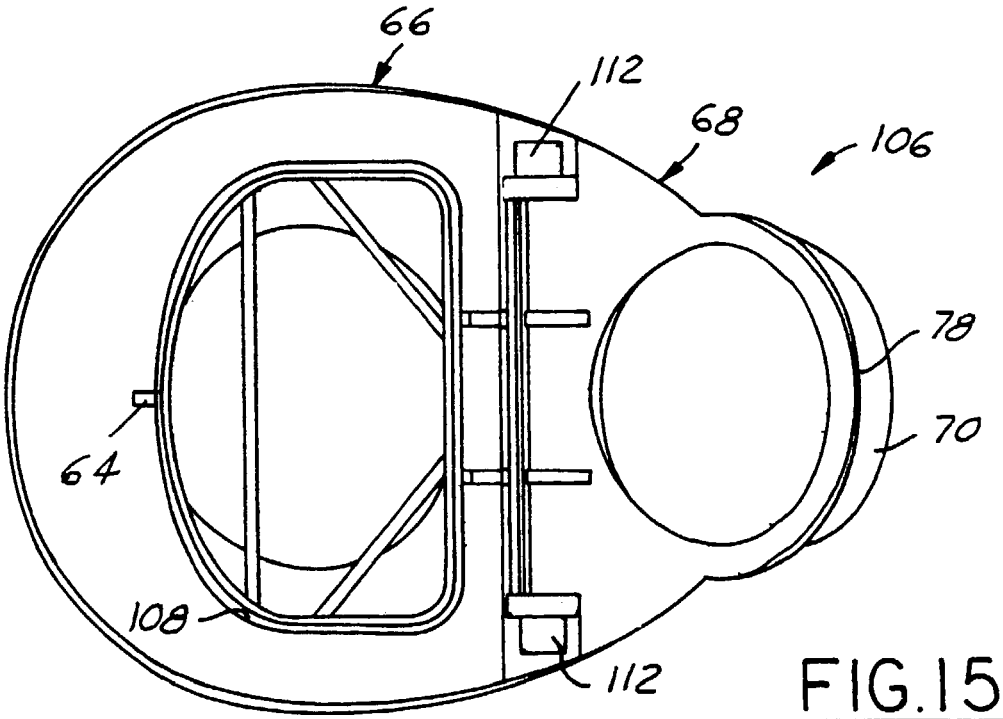
FIG. 15 is a bottom view of a toggle lid.

As best shown in FIG. 13, this closure 100 has a base 102 with a generally rectangular dispensing opening 104 formed in the base 102, and the toggle lid 106, as shown in FIG. 15, has a complementary shaped depending seal wall 108 adapted to be received within and to seal the dispensing opening 104 when the toggle lid 106 is in its closed position. As shown in FIGS. 13 and 14, a pair of spaced apart flanges 108 on the base 102 have aligned pockets 50 which define in part the pivot connection between the base and toggle lid. Likewise, the toggle lid 106 has a pair of spaced apart trunions 112 (FIG. 15) each adapted to be received in an associated one of the through holes 110 on the base 102 to permit pivotal or rotational movement of the toggle lid 106 relative to the base 102 between its open and closed positions. Preferably, the distance between pockets 50 is less than the distance between the outer ends of the trunions 112 so that the trunions 112 are pressed or snapped into the pockets 50 and so that the outer ends of the trunions 112 extend through the pockets 50 to ensure a durable pivotal connection between the toggle lid 106 and base 102. The remainder of the toggle lid 106 and base 102 may be formed generally described with reference to the first embodiment closure 14.

FIGS. 16–22 illustrated a closure 120 according to a third presently preferred embodiment of the present invention. To the extent that the third embodiment closure is the same as the first or the second embodiment closures, 14, 100, respectively, the same reference numbers will be used.

Figure 19:
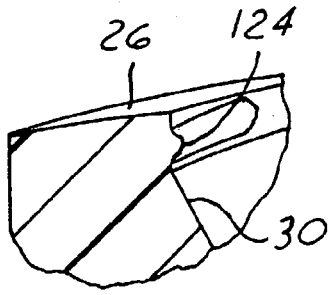
FIG. 19 is a fragmentary sectional view taken generally along line 19—19 in FIG. 17.

As best shown in FIGS. 18 and 20, the third embodiment closure 120 may use a similar pivotal connection including trunions 112, flanges 108 and through holes 110 as described with reference to the second embodiment closure 100. The first portion 66 of the toggle lid 128 has a peripheral edge portion 126 including an angled lip 134 that engages the lip 30 on the base 122 of the closure 120 to provide a seal between the toggle lid 128 and base 122. A protruding bead 124 on the lip 30 of the base 122 may be provided to help releasably secure the toggle lid 128 in its closed position on the base 122. As best shown in FIGS. 18 and 19, the protruding bead 124 is preferably disposed below the upper edge 26 of the base 122.

Figure 16:
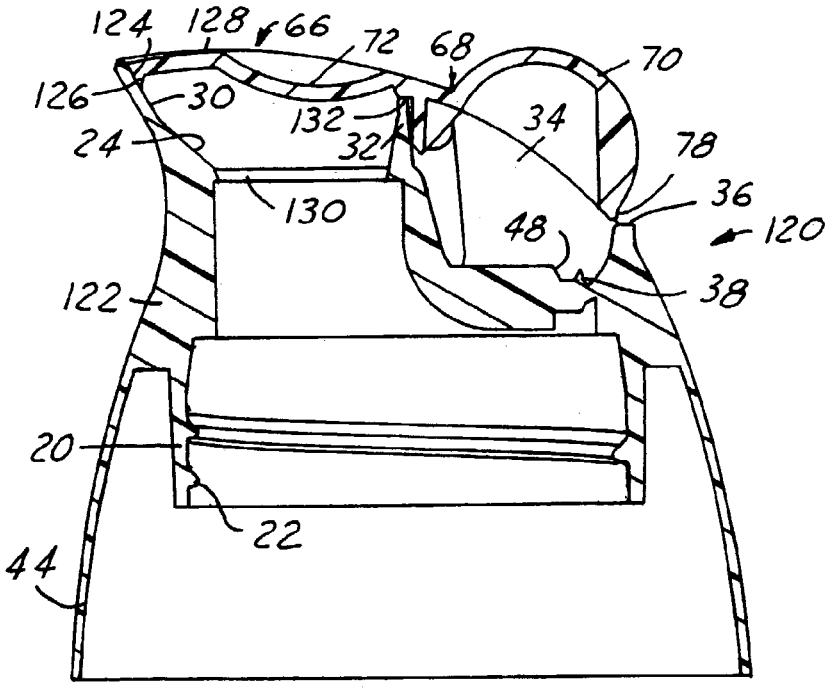
FIG. 16 is a sectional view of a closure according to a third embodiment of the present invention.
Figure 17:
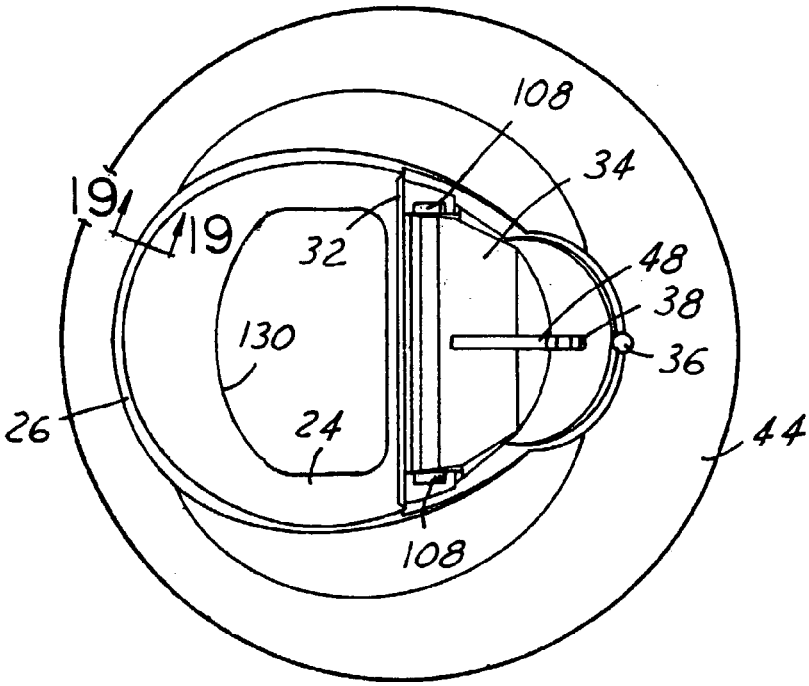
FIG. 17 is a plan view of a base of the closure shown in FIG. 16.

The toggle lid 128, as best shown in FIGS. 16 and 20–22, preferably does not have a depending plug seal wall as in the first two embodiment closures. Rather, to seal the dispensing opening 130, the toggle lid 128 of the third embodiment closure 120 has a laterally extending rim 132 which engages the upstanding wall 32 on the deck 24, as best shown in FIG. 16. Additionally, the edge portion 126 of the toggle lid 128 has the angled lip 134 that is provided at a complementary angle to the angled lip 30 of the base 122. The lip 134 on the toggle lid 128 is received closely adjacent and preferably firmly abutting the angled lip 30 of the base 122 when the toggle lid 128 is in its closed position to provide a seal between them.

As best shown in FIGS. 16, 21 and 22, the lip 134 on the toggle lid 128 provides a thickness at the edge 126 that is greater than the thickness of the adjacent portion of the toggle lid 128 to increase the sealing surface area. Desirably, the angled lip 134 extends about the periphery of the first portion 66 of the toggle lid 128 and meets with opposed ends of the rim 132 to provide a substantially continuous sealing area on the toggle lid 128 surrounding the dispensing opening 130. The remainder of the third embodiment closure 120 may be substantially identical to that described with reference to the second embodiment closure 100.

Persons of ordinary skill in the art will recognize that the above description of several embodiments of the present invention is illustrative of the present invention and not limiting. A number of presently preferred embodiments of the invention have been disclosed, and a number of modifications and variations have been suggested. Other modifications and variations may be made without departing from the sprit and broad scope of the present invention as set forth in the appended claims. For example, without limitation, the pivotal connection between the toggle lid and the base can take other forms or arrangements, as can the protrusions on the toggle lid and base of the closure.

What is claimed is:

1. A dispensing closure, comprising:

a base having a deck with a dispensing opening, a skirt for securement to a container finish, a recess adjacent to said deck, a first protrusion at an edge of said recess and a second protrusion in said recess spaced from said second protrusion;

a toggle lid having a first portion overlying said deck and closing said dispensing opening in a closed position of said lid, and a second portion extending oppositely of said first portion and overlying said recess in the closed position of said lid;

said lid being carried by the base for pivotal movement between said closed position, and an open position in which said first portion of said lid is spaced from said deck and said second portion of said lid is disposed at least in part in said recess; and said lid having a third protrusion at an edge of said second portion for cooperating with said first protrusion to releasably hold said lid in said closed position and said second protrusion to releasably hold said lid in said open position;

said base including a lip extending at an angle radially and axially from a periphery of said deck to drain any excess product dispensed from said opening back onto said deck toward said opening.

2. The closure set forth in claim 1 wherein said base further includes a wall upstanding from said deck between said dispensing opening and said recess to inhibit flow of product from said deck into said recess.

3. The closure set forth in claim 1 wherein said first portion of said toggle lid includes a wall for plug-sealing receipt in said dispensing opening in said closed position of said lid, and an external bead around said wall for snap-securement of said first portion of said lid to said base in said closed position of said lid.

4. The closure set forth in claim 1 wherein said lid includes a button upstanding from said second portion of said lid.

5. The closure set forth in claim 1 wherein the toggle lid has a lip that engages said lip of said base to provide a seal between them.

6. The closure set forth in claim 5 wherein the base has a protruding bead on said lip of said base to releasably secure the toggle lid in its closed position.

7. The closure set forth in claim 1 which also comprises a stop in said recess that limits movement of the second portion of the toggle lid.

8. The closure set forth in claim 5 wherein the base has an upstanding wall disposed between the dispensing opening and the recess, and the toggle lid has a laterally extending rim adapted to engage the upstanding wall when the toggle lid is in its closed position to provide a seal between said rim and said upstanding wall.

9. The closure set forth in claim 8 wherein the upstanding wall extends between opposed sides of the lip of the base and the rim has opposed ends that meet with the lip of the toggle lid so that when the toggle lid is in its closed position, engagement of the lip of the toggle lid with the lip of the base and engagement of the rim with the upstanding wall provides a substantially continuous seal surrounding the dispensing opening.

10. A dispensing closure, comprising:

a base having a deck with a dispensing opening, a skirt for securement to a container finish, a recess adjacent to said deck, a first protrusion at an edge of said recess and a second protrusion in said recess spaced from said second protrusion;

a toggle lid having a first portion overlying said deck and closing said dispensing opening in a closed position of said lid, and a second portion extending oppositely of said first portion and overlying said recess in the closed position of said lid;

said lid being carried by the base for pivotal movement between said closed position, and an open position in which said first portion of said lid is spaced from said deck and said second portion of said lid is disposed at least in part in said recess; and said lid having a third protrusion at an edge of said second portion for cooperating with said first protrusion to releasably hold said lid in said closed position and said second protrusion to releasably hold said lid in said open position;

said first portion of said toggle lid including a wall for plug-sealing receipt in said dispensing opening in said closed position of said lid, and an external bead around said wall for snap-securement of said first portion of said lid to said base in said closed position of said lid.

11. The closure set forth in claim 10 wherein said base includes a lip extending at an angle radially and axially from a periphery of said deck to drain any excess product dispensed from said opening back onto said deck toward said opening.

12. A dispensing closure that includes:

a base having a deck with a dispensing opening, a skirt for securement to a container finish and a recess adjacent to said deck, and a lid having a first portion overlying said deck for closing said dispensing opening, a second portion extending oppositely from said first portion and overlying said recess, and a pivot portion between said first and second portions pivotally coupling said lid to said deck so that depression of said second portion of said lid into said recess of said base pivots said first portion away from said dispensing opening, characterized in that said base includes a pour lip extending at an angle radially and axially from a periphery of said deck to pour contents from said dispensing opening and drain any excess back onto said deck toward said dispensing opening, and said base includes a wall upstanding from said deck and extending across said deck adjacent to said recess to prevent flow of product from said deck into said recess.

13. The closure set forth in claim 12 wherein said first portion of said lid internally engages said lip in a closed position of said lid over said dispensing opening.

14. The closure set forth in claim 13 wherein said first portion of said lid includes a wall (60 or 108) for plug-sealing receipt within said dispensing opening in said closed position of said lid.

15. The closure set forth in claim 14 wherein said wall has an external bead for snap-securement of said first portion of said lid to said base in said closed position of said lid.

16. The closure set forth in claim 12 wherein said lid includes a button upstanding from said second portion of said lid to facilitate manual movement of said second portion of said lid into said recess of said base.

17. The closure set forth in claim 16 including an external pocket on said first portion of said lid to facilitate manual movement of said lid to said closed position.

18. The closure set forth in claim 12 including a first protrusion at an edge of said recess on said base, a second protrusion within said recess spaced from said first protrusion, and a third protrusion at an edge of said second portion of said lid for cooperating with said first protrusion releasably to hold said lid in a closed position over said dispensing opening and with said second protrusion releasably to hold said lid in an open position spaced from said dispensing opening.

19. The closure set forth in claim 12 including a stop in said recess to limit movement of said second portion of said lid.

20. The closure set forth in claim 12 including a lip on said lid that internally engages said lip of said base to provide a seal therebetween.

21. The closure set forth in claim 12 wherein said base has an internal bead on said lip of said base releasably to secure said lid in said closed position.

22. The closure set forth in claim 12 in which said lid has a rim that extends laterally across said lid to engage said upstanding wall on said base when said lid is in the closed position of said lid to provide a seal between said rim and said upstanding wall.

23. A package that includes a closure as set forth in claim 12 in combination with a container having a finish to which said closure is secured.

* * * * *